United States Patent [19]

Harper et al.

[11] 4,289,993

[45] Sep. 15, 1981

[54] DIRECT CURRENT POWER SOURCE FOR AN ELECTRIC DISCHARGE LAMP

[75] Inventors: Clarence E. Harper, Yuciapa, Calif.; William J. Elliott, Zephyr Cove, Nev.

[73] Assignee: Quietlite International, Ltd., Reno, Nev.

[21] Appl. No.: 53,406

[22] Filed: Jun. 29, 1979

Related U.S. Application Data

[63] Continuation-in-part of Ser. No. 911,984, Jun. 2, 1978, abandoned.

[51] Int. Cl.[3] ..... H05B 41/36

[52] U.S. Cl. ..... 315/311; 315/208; 315/308; 315/DIG. 7

[58] Field of Search ..... 315/208, 205, 307, 308, 315/311, DIG. 7, 291

[56] References Cited

U.S. PATENT DOCUMENTS

| | | | |
|---|---|---|---|
| 3,486,070 | 12/1969 | Engel | 315/225 |
| 3,767,970 | 10/1973 | Collins | 315/311 X |
| 3,801,867 | 4/1974 | West et al. | 315/311 X |
| 3,999,100 | 12/1976 | Dendy et al. | 315/308 |

*Primary Examiner*—Eugene R. La Roche

*Attorney, Agent, or Firm*—Allegretti, Newitt, Witcoff & McAndrews

[57] ABSTRACT

A circuit for supplying controlled direct current power to an electric discharge vapor lamp during ignition, warm-up and normal operation. A bridge rectifier and a capacitor voltage doubler convert standard alternating current line voltage into a direct current voltage of adequate magnitude to operate the lamp. The lamp is connected in series with a semiconductor control circuit across the DC supply. The semiconductor control circuit operates as a resistive ballast whose effective resistance decreases as vapor pressure within the lamp increases during warm-up, thereby limiting lamp current to a safe value immediately after ignition while reducing the amount of power dissipated in the ballast circuit during normal operation for improved efficiency. In a second embodiment, the conductivity of the resistive ballast circuit is controlled in response to variations in both lamp voltage and lamp current to control the amount of power delivered to the lamp. In a third embodiment, controlled rectifiers in the bridge maintain a constant voltage drop across the semiconductor ballast circuit and a self-oscillating source of firing pulses is employed to start the lamp.

6 Claims, 11 Drawing Figures

DIRECT CURRENT POWER SOURCE FOR AN ELECTRIC DISCHARGE LAMP

CROSS-REFERENCE TO RELATED APPLICATION

This application is a continuation-in-part of U.S. application Ser. No. 911,984, filed June 2, 1978, now abandoned and entitled "High Intensity Discharge Lamp Ballast."

SUMMARY OF THE INVENTION

This invention relates to a direct current solid state ballast for efficiently supplying regulated electrical power to an electric discharge lamp.

In comparison to conventional incandescent (tungsten filament) lamps, electric discharge lamps produce light with much greater efficiency and have a much longer life. As awareness of the need to conserve energy and to reduce maintenance costs has grown, high intensity discharge (HID) lamps have become the frequent choice over incandescent lamps, particularly in outdoor lighting applications such as street and highway lighting, security lighting and the like.

Conventional HID lamps are normally powered by alternating current which flows through an inductive (magnetic core and coil) ballast. The ballast is needed in order to limit the current flow through the negative-resistance discharge lamp. In order to house and support the necessarily large and heavy magnetic ballast, the lamp fixtures and fixture supports themselves must be large and sturdy. Thus, the relatively high overall installation cost of HID lighting systems can be attributed primarily to the cost, size and weight of the conventional AC magnetic ballast.

In an effort to reduce the size of the ballast required, high-frequency solid-state ballasts have been developed which greatly reduce the size of the ballast inductor required. Using the principles of the "switching-regulator" transistor power supply, one or more semiconductor switches are employed to supply high-frequency voltage pulses to the lamp through a "coasting" inductor, current through the lamp and the coasting conductor being sustained through a parallel "flyback" diode when the switch is off. Such a high-frequency solid-state ballast is disclosed, for example, in U.S. Pat. No. 3,486,070, issued on Dec. 23, 1969 to J. C. Engel.

One significant advantage of the high-frequency solid-state ballast is that, unlike the conventional AC magnetic ballast, it delivers direct current to the lamp, eliminating the undesirable flicker or stroboscopic effect common to AC driven lamps. Moreover, the high frequency employed eliminates the objectionably loud 120 cycle audible hum typically given off by many AC magnetic ballasts, making their use particularly undesirable in most indoor applications.

The primary disadvantage of high-frequency ballast circuits is their tendency to emit high-level electromagnetic emissions and radio-frequency interference. Because the semiconductor devices operate in the switching mode to produce high-frequency, square wave power signals rich in harmonics, substantial EMI and RFI signals are generated. An attempt to limit the severity of this problem by reducing the switching frequency requires that the size of the inductor be increased, and may also result in the generation of audible or ultrasonic acoustic signals which may shorten lamp life through vibrational fatigue.

It is accordingly a principal object of the present invention to provide a small, lightweight, inexpensive, source of regulated DC power which may be employed to efficiently operate an electric discharge lamp during start-up, warm-up and sustained use without generating electromagnetic interference or acoustic vibrations.

In accordance with a principal feature of the invention, the discharge lamp is serially connected with a semiconductor ballast circuit across a source of a direct current potential. The ballast circuit monitors and regulates the flow of power to the lamp by limiting the flow of current to the lamp to a safe value when the lamp is first ignited and thereafter by decreasing the effective resistance of the control circuit as the vapor pressure within the lamp increases, thereby greatly reducing the power dissipated in the ballast circuit during normal operation for increased efficiency.

In a preferred arrangement employing the principles of the invention, the semiconductor ballast circuit connected in series with the lamp comprises a fixed ballast resistor and one or more transistors connected in parallel. At the time the lamp ignites, the parallel transistor is substantially non-conducting so that substantially all of the lamp current flows through the fixed ballast resistor. As lamp voltage increases and lamp current decreases (due to increasing vapor pressure within the lamp during the warm-up period), means are employed for increasing the conductivity of the transistor(s), providing a secondary source of current for the lamp, and reducing the effective resistance and power dissipation of the ballast circuit.

In accordance with a further aspect of the invention, the conductivity of the semiconductor ballast circuit is increased whenever the magnitude of current flowing through the lamp decreases below a threshold current level.

In accordance with still another feature of the invention, the power delivered to the lamp may be advantageously controlled by decreasing the aforementioned threshold current level in response to increases in the voltage across said lamp as vapor pressure within the lamp increases.

According to a further feature of the invention, a pre-regulator may be advantageously employed to maintain a substantially constant voltage across the semiconductor ballast circuit and to control current flow through the lamp in response to and in cooperation with changes in the effective resistance of the control circuit.

In a preferred arrangement utilizing the principles of the invention, the pre-regulator advantageously takes the form of a controlled-rectifier tracking pre-regulator which applies a voltage across the series combination of the lamp and the semiconductor ballast circuit which is equal to the lamp voltage plus a substantially constant offset voltage.

BRIEF DESCRIPTION OF THE DRAWINGS

These and other objects, features and advantages of the present invention are discussed in greater detail in the description which follows. During the course of this description, frequent reference will be made to the attached drawings in which.

DETAILED DESCRIPTION OF THE INVENTION

Electric discharge lamps produce light by the passage of electrons at tremendous speeds through a vapor or gas. When the electrons collide with the atoms of the gas, they alter the atomic structure of the gas atoms by temporarily raising their energy levels. As the disturbed atoms return to their normal energy states, they give off photons of light at one or more discrete wave lengths. Discharge lamps include carbon arc lamps, fluorescent lamps, and (of particular interest here) a highly efficient, compact and long-lived class of lamps generally called high intensity discharge (HID) lamps. HID lamps include mercury vapor, metal halide mercury vapor, and sodium vapor lamps.

Figure 1:
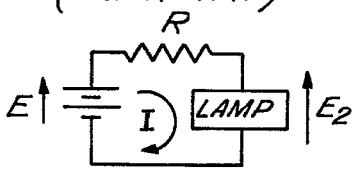
Fig. 1 (PRIOR ART)
FIGS. 1, 2 and 3 illustrate the operating characteristics of a typical electric discharge lamp powered by the combination of a direct-current voltage source and a fixed resistance ballast.
Figure 2:
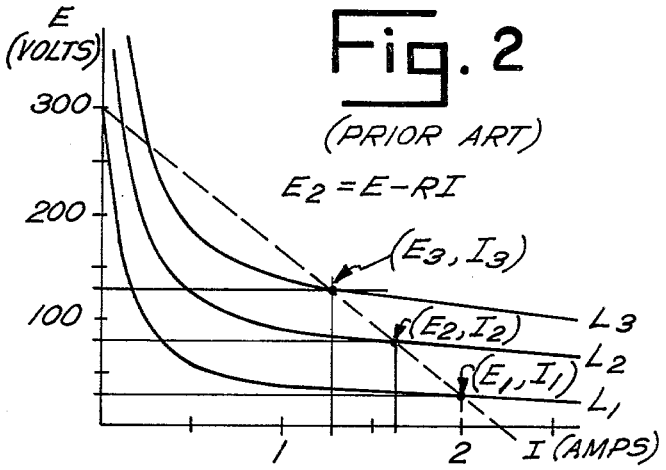
Fig. 2 (PRIOR ART)

Electric discharge lamps, once lit, exhibit a "negative resistance" characteristic; that is, as current through the lamp increases the voltage across the lamp decreases. The voltage/current characteristics of a typical electric discharge vapor lamp powered by a simple fixed-resistance ballast are illustrated by FIGS. 1 and 2 of the drawings. As seen in FIG. 1, the lamp is connected in series with a fixed resistance R across a source of a direct current voltage E.

The open-circuit voltage E must be sufficiently large to initiate an arc discharge between the electrodes of the lamp. A small amount of a readily ionized gas, such as argon, is frequently introduced into the arc tube to facilitate starting. Once the arc is initiated, lamp current abruptly increases to the value $I_1$, seen in FIG. 2, at which point the voltage-current characteristic of the lamp power supply (seen as the downwardly inclined, dashed line in FIG. 4) intersects the volt-ampere characteristic curve $L_1$ of the "cold" lamp. Thus, immediately after ignition, the lamp current $I_1$ is relatively high and the voltage across the lamp $E_1$ is relatively low. As the lamp continues to burn its heat begins to vaporize the mercury, increasing the mercury vapor pressure within the arc tube. When the lamp is partially heated, its volt-ampere characteristics are altered as illustrated by the curve $L_2$. After two or three minutes, the lamp reaches its normal operating temperature and the mercury in the tube is fully vaporized yielding a lamp characteristic as illustrated by the curve $L_3$.

The actual voltage across and the current through the lamp is determined at any time by the intersection of the lamp's operating characteristic curve and the linear voltage-current characteristic of the fixed resistance power source. As seen in FIG. 2, as the lamp warms the voltage across it gradually increases to its final operating level $E_3$ while the lamp current decreases to the level $I_3$.

Figure 3:
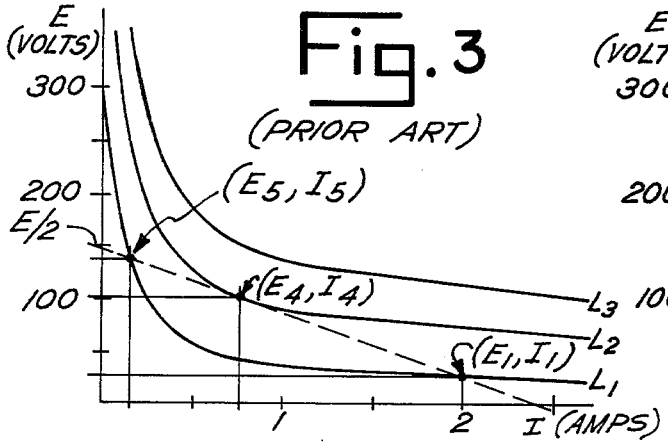
Fig. 3 (PRIOR ART)

While such a fixed resistance ballast is quite workable, it is exceedingly inefficient. The power dissipated in the ballast resistance is proportional to the square of the ballast voltage $(E-E_L)^2$. Since the voltage across the ballast is high, particularly during lamp start-up, substantial energy is lost in the ballast. If an attempt is made to improve efficiency by reducing the source voltage and the ballast resistance, immediate difficulty is encountered as illustrated by FIG. 3. By reducing the source voltage to a lower value E/2, and also reducing the resistance of the ballast, initial lamp current can still be limited to the value $I_1$ as depicted in FIG. 3. Note, however, that some auxiliary means for igniting the lamp must be provided since the reduced open-circuit voltage E/2 is inadequate to initiate conduction. Moreover, as the lamp warms up beyond the point where it has the voltage-current characteristic $L_2$, the lower-voltage, lower-resistance power supply is no longer adequate to maintain the arc. As a result, when the lamp voltage reaches the value $E_4$ and the lamp current decreases to the value $I_4$, the lamp self-extinguishes.

Before considering the principles of the present invention, a further observation should be made concerning the stability of the lamp's operating point. Note that, as seen in FIG. 3, the cold lamp's operating characteristic curve $L_1$ also intersects the operating characteristic of the source at the point $(E_5,I_5)$. This is not, however, a stable operating point because, as current through the lamp increases, the voltage across the lamp is decreasing faster than the voltage across the ballast is increasing. Said another way, in order for the lamp's operating point to be stable, the effective dynamic resistance of the ballast $dE_B/dI$ must be greater than the effective dynamic negative resistance of the lamp $dE_L/dI$. The fact that a lamp can be operated stably provided that the effective dynamic resistance of the ballast is sufficiently high, regardless of its actual resistance, plays a significant role in the development and understanding of the principles of the present invention.

Figure 4:
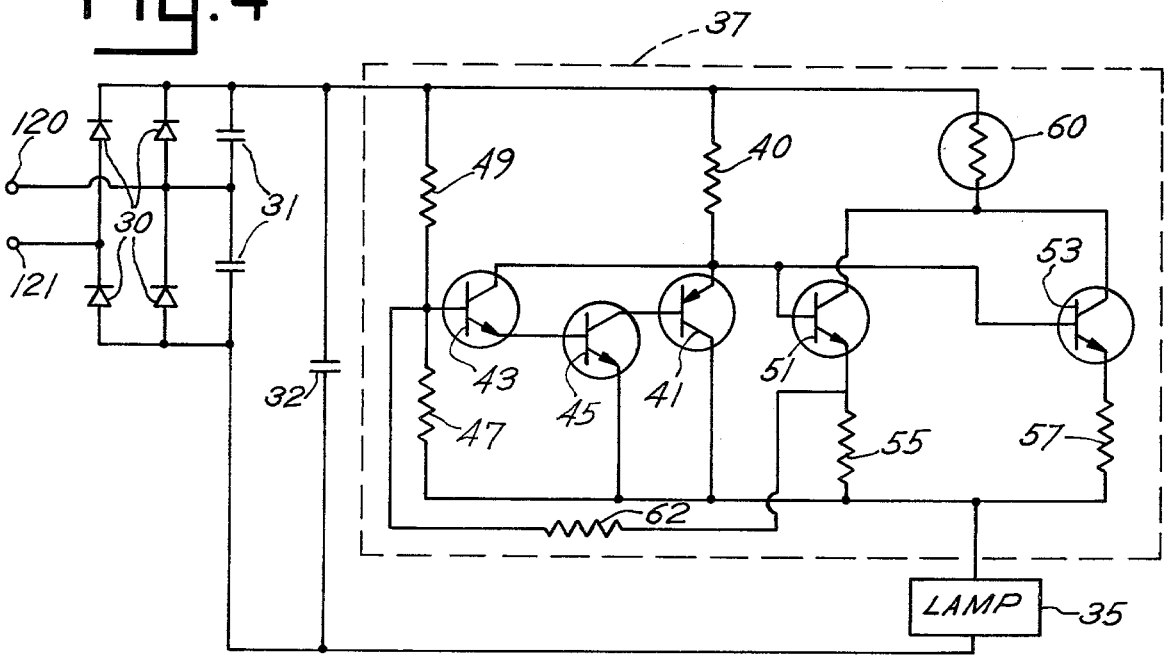
FIG. 4 is a schematic diagram of a first embodiment of the invention.

The solid-state ballast circuit shown in FIG. 4 of the drawings illustrates a first technique for improving the efficiency of a direct current, resistively-ballasted electric discharge lighting system. A conventional voltage doubling bridge rectifier comprising the diodes 30, voltage doubling capacitors 31, and a filter capacitor 32 supplies a direct current potential across the series combination of a discharge lamp 35 and a semiconductor control circuit indicated generally within the dotted line 37. As will be seen, the control circuit 37 operates as a resistive ballast whose resistance is high when lamp voltage is low and whose resistance decreases as lamp voltage increases during warm-up. In this way the control circuit 37 provides the high resistance needed to limit lamp current at lamp ignition time and a resistance of greatly reduced value to limit the power consumed by the ballast during normal operation.

A typical mercury vapor lamp requires a power supply having an open circuit voltage of approximately 300 volts. This voltage is produced by the voltage doubling capacitors 31 to cause lamp ignition. The voltage across the lamp 35 thereafter abruptly drops to a value of approximately 25 volts or lower. The substantial lamp current drawn after ignition reduces the voltage across filter capacitor 32 to approximately 160 volts (the capacitors 31, having relatively low capacitance, create a voltage doubling action only when it is needed to start the lamp; that is, under open circuit conditions).

Immediately after the lamp is ignited, substantially all of the lamp current flows through the series combination of a fixed ballast resistor 40 and a transistor 41. Transistor 41 is driven by the cascaded combination of transistors 43 and 45 whose conductivity is controlled by the voltage across resistor 47.

The resistors 47 and 49 together form a voltage divider connected across the semiconductor ballast circuit 37. Because the voltage across ballast circuit 37 is high when lamp voltage is low, transistors 43, 45 and 41 are fully conductive immediately after the lamp ignites.

Two power transistors 51 and 53 have their bases connected to the junction of the fixed ballast resistor 40 and transistor 41. Emitter resistors 55 and 57 are serially connected with the transistors 51 and 53, respectively, to insure that these two power transistors equally share the current load flowing through them. A thermistor 60 connects the collectors of the power transistors 51 and 53 to the positive terminal of the filter capacitor 32. The thermistor 60 presents a high resistance when cold to protect the power transistors 51 and 53 against surge currents which may occur during start-up. The thermistor 60 typically possesses a resistance of 120 ohms when cold, its resistance declining rapidly (within 10 to 15 seconds of operation) to one or two ohms. A feedback resistor 62 connects the emitter of one of the transistors 51 to the base of the ballast voltage sensing transistor 43 to limit the gain and insure the stability of the cascaded amplifying transistors which make up the circuit 37.

As vapor pressure within the lamp 35 increases, the voltage across the lamp increases and the voltage across the circuit 37 decreases. As the ballast voltage decreases, transistors 43, 45 and 41 become less conductive, raising the voltage at the emitter of transistor 41 and causing the power transistors 51 and 53 to become conductive. In this way, additional operating current is provided to the lamp 35 via the parallel power transistors 51 and 53. If this additional current was not made available, the lamp would self-extinguish (as previously noted in connection with the discussion of FIG. 3) since the fixed ballast resistor 40 by itself is incapable of supplying adequate current to sustain the arc at higher lamp vapor pressures.

Figure 5:
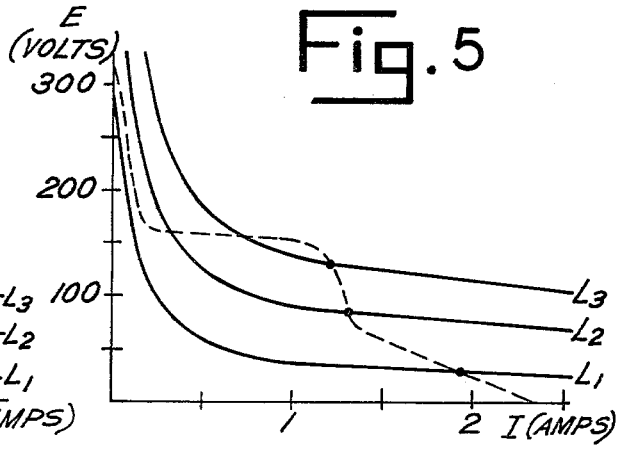
FIG. 5 illustrates the operating characteristics of the circuit of FIG. 4.

The operating characteristics of the circuit shown in FIG. 4 are graphically depicted in FIG. 5 of the drawings. The volt-ampere characteristics of the combination of the voltage doubling bridge rectifier and the semiconductor control circuit 37 are depicted by the dashed line curve in FIG. 5. Under open circuit or very low load current conditions, the voltage doubling capacitors 31 produce a maximum output voltage of approximately 320 volts to ignite the lamp 35. Lamp current immediately surges to the stable operating point on curve $L_1$, the volt-ampere characteristic of the lamp when substantially no mercury has yet vaporized.

Because the resistance of the ballast circuit 37 increases as lamp voltage decreases, the voltage/current characteristic of the lamp power supply (the dashed, curved line in FIG. 5) is no longer linear. This non-linear voltage/current characteristic greatly reduces the power consumed by the ballast during sustained operation. As seen in FIG. 5, the final operating point (on curve $L_3$) permits the lamp (e.g., a type H39 175-watt mercury vapor lamp) to operate at its rated power (e.g., 130 volts at a current of approximately 1.35 amperes). The normal operating voltage across the ballast circuit is reduced dramatically (from approximately 170 volts using the fixed resistance illustrated in FIG. 3 to approximately 40 volts using the semiconductor control circuit of FIG. 5) such that energy loss in the ballast circuit is significantly reduced.

One disadvantage suffered through the adoption of the circuit of FIG. 4 may be appreciated by comparing FIGS. 2 and 5. Note that the fixed resistor ballast applies higher starting and warm-up currents to the lamp prior to reaching the specified normal operating point. This disadvantage can be remedied, and other advantages obtained, through the use of a power-regulating semiconductor control circuit of the type illustrated in FIG. 6 of the drawings. As in the circuit of FIG. 4, the power regulating circuit of FIG. 6 is driven by a conventional voltage doubling bridge rectifier which supplies direct current potential to the series combination of a semiconductor control circuit (indicated generally within the dashed line rectangle 100) and the lamp 35. [In the control circuit 100, those components having substantially the same function previously discussed in connection with FIG. 4 are indicated with the same numbers in FIG. 6 and a discussion of their function need not be repeated here.]

Figure 6:
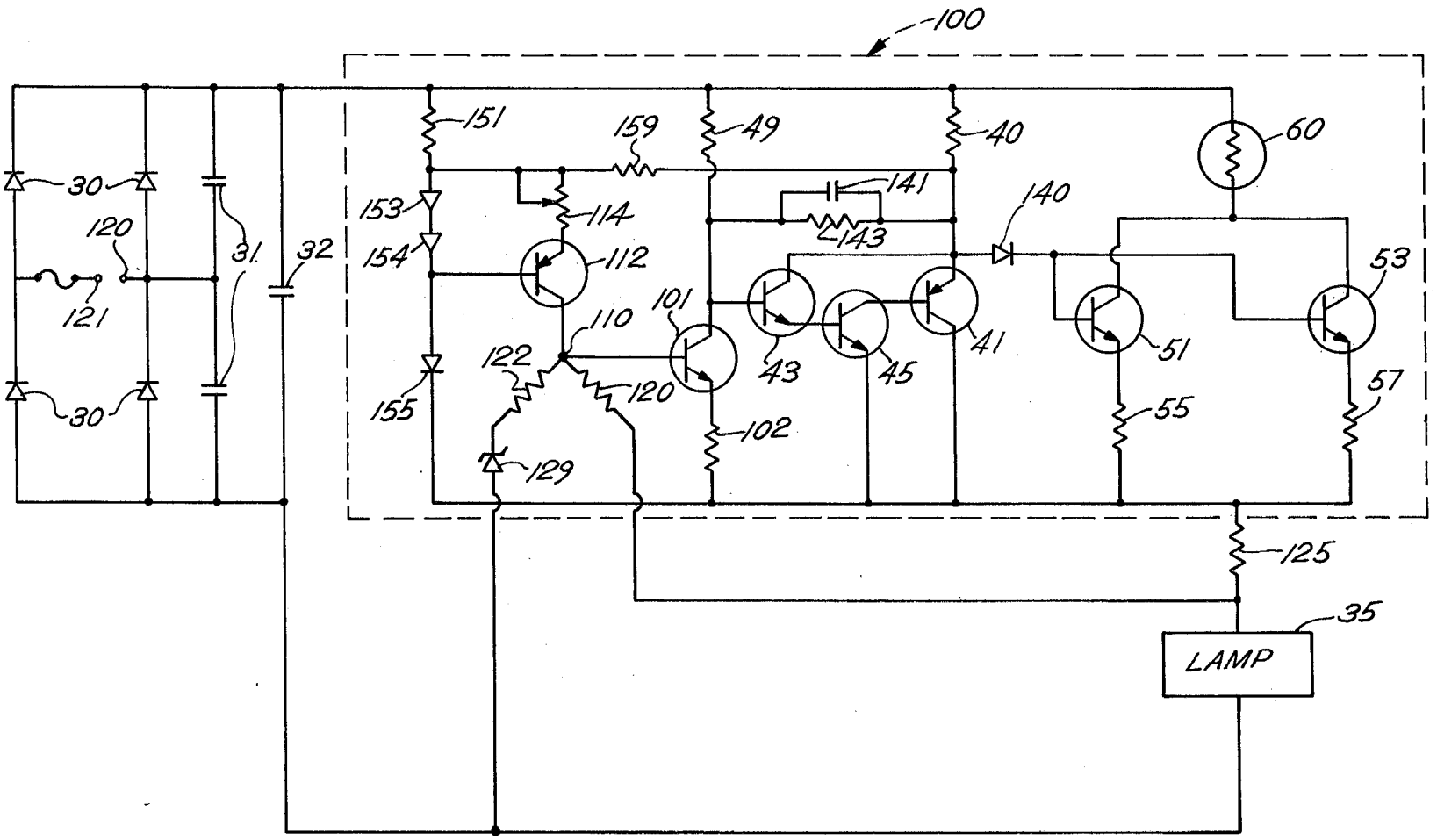
FIG. 6 is a schematic diagram of a second embodiment of the invention.

The primary difference between the circuits of FIGS. 4 and 6 resides in the manner in which the conductivity of the power transistors 51 and 53 is controlled. In the circuit shown in FIG. 6, transistor 101 is connected in series with an emitter resistance 102 between the base of transistor 43 and the emitter of transistor 45. The base of transistor 101 is in turn connected to a current summing node 110. The collector of transistor 112 acts as a constant current source, drawing a constant electron flow from the node 110 (the value of this constant current being selectable by adjusting potentiometer 114). Electrons flow into the node 110 through resistor 120 and through resistor 122.

Resistor 120 is connected between the summing node 110 and the junction of lamp 35 and current sensing resistor 125; hence, the electron flow into node 110 through resistor 120 is proportional to lamp current.

Resistor 122 connects summing node 110 to the cathode of a zener diode 129 whose anode is connected to the negative terminal of the DC voltage supply. Because the voltage drop across resistor 120 is necessarily small in comparison to lamp voltage, current flows through resistor 122 only when lamp voltage exceeds the breakdown voltage of the zener diode 129 (e.g., 72 volts).

Figure 7:
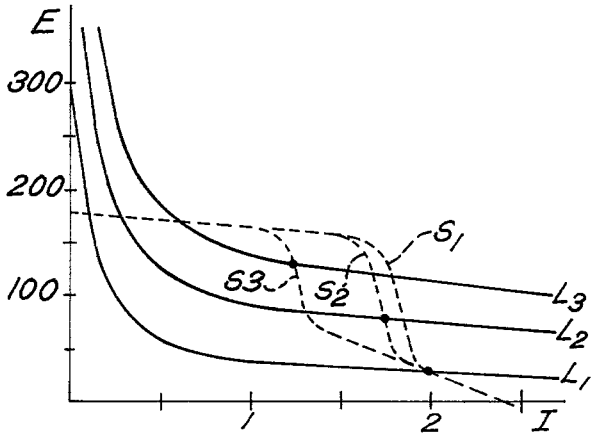
FIG. 7 illustrates the operating characteristics of the circuit of FIG. 6.

The operation of the circuit shown in FIG. 6 is illustrated by the operating characteristic curves shown in FIG. 7 of the drawings. As seen in FIG. 7, immediately after lamp ignition power transistors 51 and 53 are fully off and substantially all of the lamp current flows through the ballast resistor 40 which limits lamp current to approximately two amperes, the stable operating point on the lamp's "cold" volt-ampere characteristic curve $L_1$. Since the lamp voltage immediately after ignition is well below the breakdown voltage of the zener diode 129, no current flows through resistor 122 and the conductivity of transistor 101 is hence solely determined by the difference between the constant current from transistor 112 and the current through resistor 120 which is proportional to lamp current. Since the voltage across the cold lamp is low (curve $L_1$), the zener diode 129 is non-conducting throughout the current range of interest and the volt-ampere characteristic of the lamp supply follows the curve $S_1$. Correspondingly, when the lamp is partially warm and takes on the volt-ampere characteristic $L_2$ the voltage across the lamp exceeds the breakdown voltage of the zener diode 129 slightly and a relatively small current flows through resistor 122. The effect of this small current is to shift the threshold current level at which transistor 101 begins to turn on to a lower value of lamp current. Finally, when the lamp reaches full operating temperature and vapor pressure, it exhibits the volt-ampere characteristic $L_3$. At this time, lamp voltage very substantially exceeds the voltage across zener diode 129 and a considerably larger current thus flows in resistor 122, with the result that the current through current sensing resistor 125 must decrease much more substantially before the transistor 101 is turned on to a greater degree.

By comparing FIGS. 5 and 7 of the drawings, it may be observed that the circuit of FIG. 6 is capable of heating the lamp to its normal operating temperature more rapidly by delivering an increased amount of current to the lamp during the warm-up period.

By appropriate component value selection, the circuit of FIG. 6 is capable of delivering substantially constant power to the lamp for all lamp voltages higher than the breakdown voltage of zener diode 129. This occurs because the lamp current is reduced as lamp voltage increases such that the product of the two remains substantially unchanged. For example, in FIG. 7 it is seen that the power delivered to the lamp when it is only partially heated (curve $L_2$) is approximately 175 watts (100 volts times 1.75 amperes). When the lamp is fully heated, its operating voltage rises to approximately 130 volts but lamp current is decreased to approximately 1.35 amperes such that the power delivered to the lamp continues to be 175 watts.

In accordance with a further feature of the invention, the circuit of FIG. 6 includes means for maintaining the conductivity of the power transistors 51 and 53 in response to any reduction in the DC supply voltage, thereby compensating for line voltage variations. This is accomplished by means of the resistor 49 which, together with transistor 101, controls the conductivity of transistor 43, etc. Should line voltage decrease, the forward base drive to transistor 43 is reduced, tending to turn off transistors 43, 45 and 41, and thereby maintaining the conductivity of power transistors 51 and 53.

As seen in FIG. 6, a diode 140 may be connected between the bases of the power transistors 51 and 53 and the emitter of transistor 41 to protect the low power control transistors from damage should a catastrophic failure occur in the circuits including the power transistors 51 and 53. Furthermore, to insure the stability of the amplifying circuit comprising the three cascaded transistors 43, 45 and 41, the parallel combination of a capacitor 141 and a resistor 143 may be connected between the emitter of transistor 41 and the base of transistor 43.

The constant current source which includes transistor 112 is powered by the combination of a resistor 151 and three forward biased diodes 153, 154 and 155. The diodes 153 and 154 provide constant voltage across the series combination of potentiometer 114 and the base-emitter junction of transistor 112. If the voltage across the ballast circuit is quite low (as it may be when lamp voltage is high and the power transistors 51 and 53 are conducting), the current flowing through resistor 151 may be inadequate to power the constant current source. At this time, however, the conductivity of transistor 41 is reduced and hence additional current is supplied to the constant current source by way of a cross-connecting resistor 159.

As previously explained, the principles of the present invention may be applied to substantially reduce the amount of power dissipated in the ballast circuit under normal operating conditions. However, practical considerations limit the extent to which the ballast voltage may be reduced. The circuit should operate effectively even though commercially available line voltage may vary from 108 to 132 volts AC. Moreover, the normal operating voltage across commercially available lamps of the same type may be expected to vary ±10%. Thus the ballast circuit must be capable of presenting an adequate voltage drop under the "worst case" condition of maximum line voltage and minimum operating lamp voltage. The following components are suitable for operating a type H39 175-watt mercury vapor lamp:

Transistors 43, 45 and 101: 2N4400
Transistors 51 and 53: DTS 431
Transistor 41: 2N6489
Transistor 112: 2N4402
Diodes 30: 3 amp.
Diodes 153, 154 and 155: 1 amp.
Diode 129: 72 volts, 10 milliwatts
Capacitor 31: 5 microfarads, 200 volts
Capacitor 32: 240 microfarads, 350 volts
Capacitor 141: 0.22 microfarads
Resistor 40: 80 ohms, 100 watt
Resistor 49: 100 K, ¼ watt
Resistors 55 and 57: 0.47 ohms, ¼ watt
Resistor 102: 68 ohms, ¼ watt
Resistor 113: 330 ohms, ¼ watt
Resistor 120: 24 K. ¼ watt
Resistor 122: 3.3 meg., ¼ watt
Resistor 125: 0.5 ohms, 5 watts
Resistor 143: 4.3 K, ¼ watt
Resistor 151: 27 K, 1 watt
Potentiometer 114: 7.5–8.5 K, ¼ watt
Thermistor 60: 120 ohms (cold)

In the circuits shown in FIGS. 4 and 6, substantial power must be dissipated by the ballast immediately after ignition. At that time, the transistors 51 and 53 are non-conducting and the large, starting lamp current flows through the fixed ballast resistor 40. Also, during warm-up, when power transistors 51 and 53 are only partially conductive, they too dissipate substantial power. Although this large amount of power dissipation in the ballast circuit does not last for long (one or two minutes), it does demand that resistor 40 and transistors 51 and 53 have high power ratings and that care be taken to provide adequate heat sinks and air convection paths to keep the ballast circuit at a safe temperature during start-up.

This disadvantage may be substantially eliminated through the use of a voltage-tracking pre-regulator which is substituted for the conventional bridge rectifier (shown in FIG. 6) and which is adapted to deliver an output voltage equal to the lamp voltage plus a predetermined constant voltage offset. In this way, the voltage across the ballast circuit may be maintained at a low level, thereby insuring reduced power consumption in the ballast circuit even during warm up. By thus insuring low power dissipation in the ballast regardless of line voltage fluctuations or variations in the operating characteristics of the lamp, the ballast may be constructed of lower power components, smaller heat sinks, and the like, thus further reducing the size and cost of the ballast while, at the same time, improving its efficiency.

Figure 8:
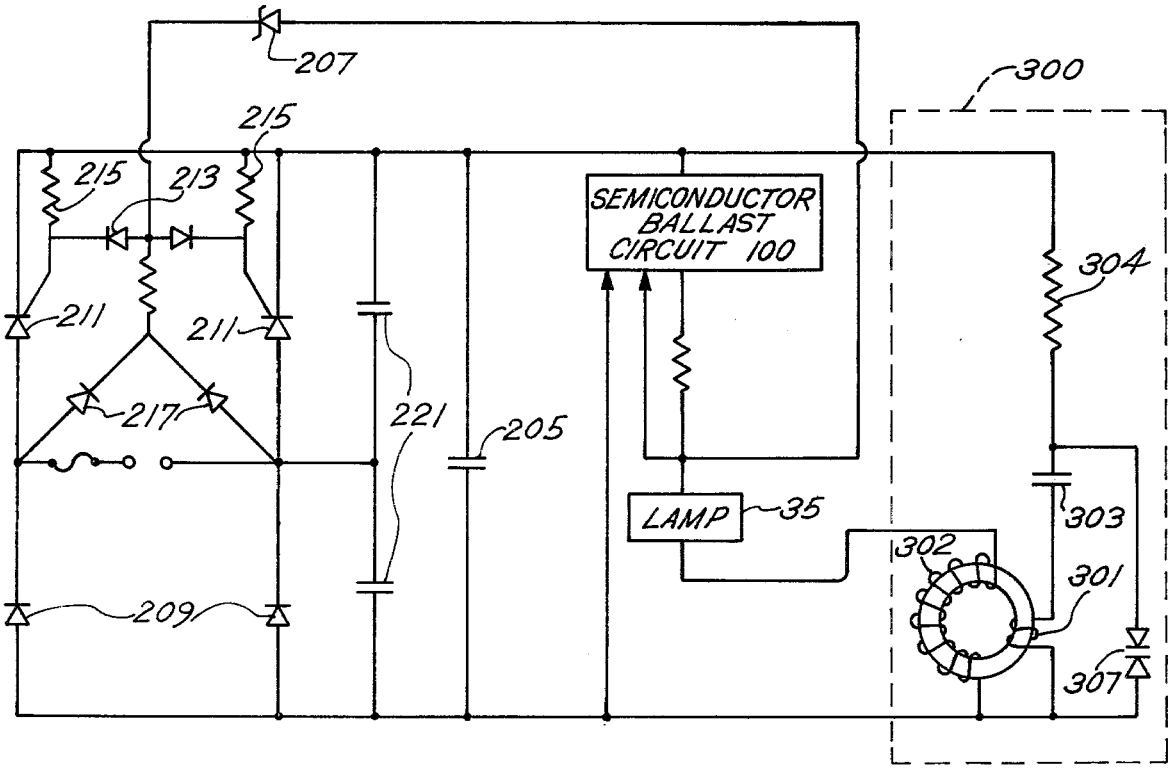
FIG. 8 is a schematic diagram of a third embodiment of the invention.

A lamp power supply circuit employing such a voltage-tracking pre-regulator is shown in FIG. 8 of the drawings. The pre-regulator converts alternating current line voltage applied to terminals 203 into a regulated DC output voltage across filter capacitor 205. The voltage across capacitor 205 is maintained at a level equal to the voltage across the lamp 35 plus a constant voltage offset established by a zener diode 207, thereby maintaining a constant voltage across the semiconductor ballast circuit 100 (shown in detail in FIG. 6).

The pre-regulator comprises a bridge circuit composed of two conventional diodes 209 and two silicon controlled rectifiers (SCR's) 211. The gate electrodes of the SCR's 211 are connected by diodes 213 to the cathode of the zener diode 207. Resisters 215 are connected between the gate and cathodes of the SCR's 211. A pair of diodes 217 connect each side of the AC supply to one terminal of a resistor 219, the other terminal of which is connected to the cathode of zener diode 207. A pair of voltage doubling capacitors 221 are connected in parallel with the filter capacitor 205.

The voltage drop across the zener diode 207 holds the DC potential at the gates of the SCR's 211 at a level equal to the lamp voltage plus a constant differential or offset value. In this way the SCR's 211 are fired (when forward-biased) whenever the voltage across capacitor 205 drops below the lamp voltage plus the constant offset voltage established by zener diode 207. Since the voltage across capacitor 205 "tracks" the lamp voltage, the voltage across the ballast circuit 100 is maintained at a substantially constant value.

The SCR tracking pre-regulator seen in FIG. 8 operates in cooperation with changes in the effective resistance of the ballast circuit 100. As vapor pressure within the lamp increases, lamp current drops and lamp voltage rises, causing the conductivity of the ballast circuit 100 to increase (as described earlier). At the same time, the SCR pre-regulator increases the effective source voltage across filter capacitor 205.

Figure 9:
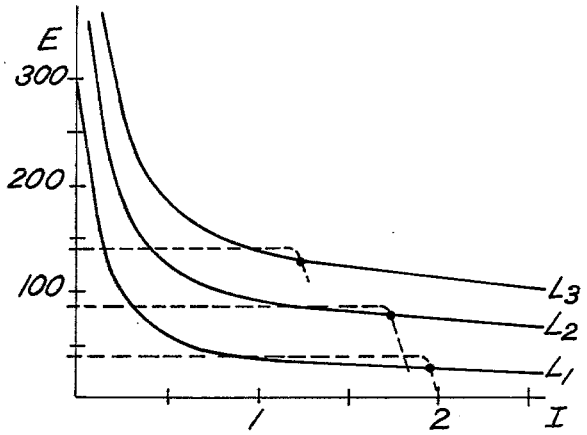
FIG. 9 illustrates the operating characteristics of the circuit of FIG. 8.

The voltage/current characteristics of the lamp power supply arrangement illustrated in FIG. 8 are shown in FIG. 9 of the drawings. When the lamp is first ignited and has the cold voltage/current characteristic $L_1$, current is limited by the ballast circuit 100 to a safe but relatively high level to insure rapid warm-up. The effective DC source voltage (that is, the voltage across filter capacitor 205) is, however, limited to a value slightly greater than the initially low lamp voltage. As the lamp warms and the voltage across it increases, the voltage across capacitor 205 increases with it, maintaining the constant voltage drop across the ballast circuit 100. As lamp voltage increases, however, the threshold current level at which the ballast circuit 100 becomes conductive decreases, so that substantially constant power is delivered to the lamp.

The voltage across the semiconductor ballast circuit 100 may include a substantial "ripple" component provided that the voltage never drops below the level needed to operate the transistors within the circuit. To reduce the magnitude of this ripple component, the value of filter capacitor 205 should be large (e.g., 1000 microfarads). However, because the power transistors 51 and 53 and the fixed ballast resistor 40 (shown in FIG. 6) no longer need to dissipate substantial power, their ratings may be greatly reduced.

Using the tracking pre-regulator, the amount of power dissipated by the semiconductor ballast circuit is no longer dependent upon the particular lamp being operated. For example, the following different commercially-available lamp types might be operated by the circuit of FIG. 8:

| Lamp Wattage | Type | Nominal Operating Voltage | Nominal Operating Current | Starting Voltage |
|---|---|---|---|---|
| 75 | H43 Mercury Vapor | 130 | .66 | 300 |
| 250 | H37 Mercury Vapor | 130 | 2.10 | 300 |
| 400 | M59 Metal Halide | 135 | 3.25 | 525 |
| 400 | S56 Sodium Vapor | 100 | 4.60 | 2500 |

In each case, the operating current is established by adjusting the potentiometer 114 (see FIG. 6). In the case of the lower-voltage sodium vapor lamp, a zener diode having a lower breakdown voltage may be substituted for the 72 volt zener diode 129 shown in FIG. 6.

It may be noted that the 320 volt open-circuit potential from the voltage-doubler alone is inadequate to start the metal halide and sodium vapor lamps listed above. Moreover, the voltage doubler is also incapable of restarting a hot mercury vapor lamp in the event of a momentary power failure. Consequently, a self-oscillating starting pulse circuit 300 of the type shown in FIG. 8 may be employed to start (or restart) the lamp 35.

In the high-voltage pulse source 300 shown in FIG. 8, the primary winding 301 of a toroidal transformer is connected in series with a storage capacitor 303 and a charging resistor 304 across the filter capacitor 205. An avalanche breakdown device 307 (a 300 volt SIDAC) becomes conductive whenever the capacitor 303 charges to 300 volts, sending a pulse of current through the primary winding 301 and generating a high (approximately 4,000 volt peak) electrostatic voltage across secondary winding 302, thereby starting conduction through the lamp by means of the well-known voltage "injection" technique.

When the lamp ignites, the voltage across capacitor 205 drops well below the 300 volts necessary to break down the SIDAC 307 and the production of starting pulses stops.

Figure 10:
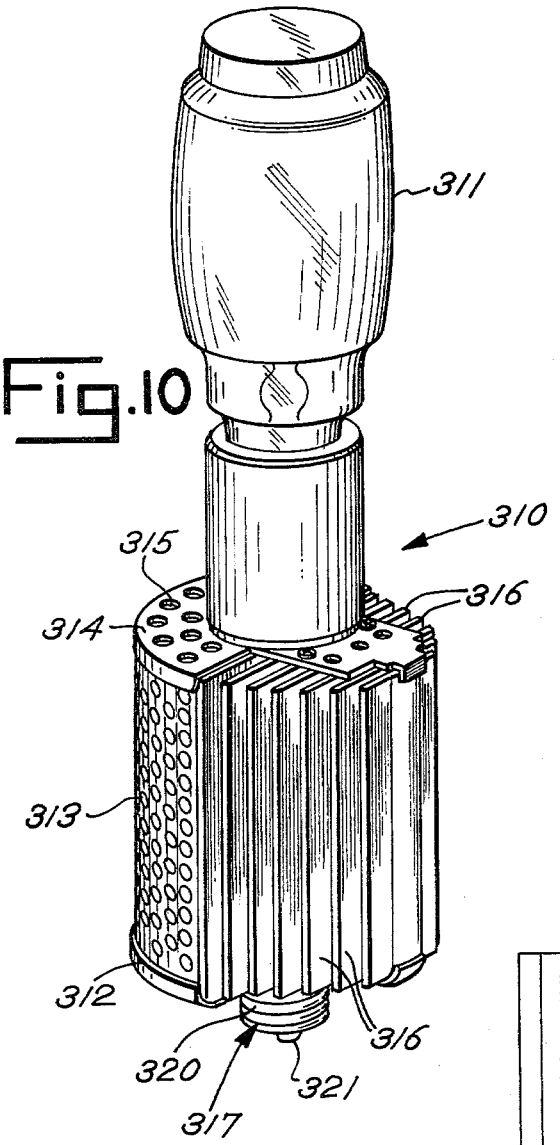
FIGS. 10 and 11 are perspective views of two compact, light-weight, solid-state ballast devices which utilize the principles of the present invention.

The principles of the present invention may be employed to construct the semiconductor DC ballast of the type illustrated in FIG. 10 of the drawings. A commercially available HID lamp bulb indicated generally at 311 is screwed into and supported by a ballast housing assembly indicated at 310. The ballast housing assembly 310 is generally cylindrical in shape and is designed to cool the ballast circuit by convection. The power transistors employed in the ballast circuit are mounted in thermal contact with the interior walls of an extruded aluminum heat sink having outwardly projecting fins 316. The heat sink, and a semi-cylindrical, perforated sheet metal housing wall 313 are sandwinched between bottom and top base-plates 312 and 314, both of which are perforated (as indicated at 315) to ventilate the interior of the housing. A standard electrical screw connector, indicated at 317, comprising a conductive center post 321 and a conductive outer jacket 320, is adapted to threadably engage and make contact with a standard light socket (from which an existing incandescent bulb may be removed and replaced by the more efficient and longer lived HID lamp and ballast assembly). Because the HID lamp and ballast assembly is both light and compact, conversion of existing incandescent fixtures to HID lighting may thus be accomplished as readily as replacing light bulbs.

Figure 11:
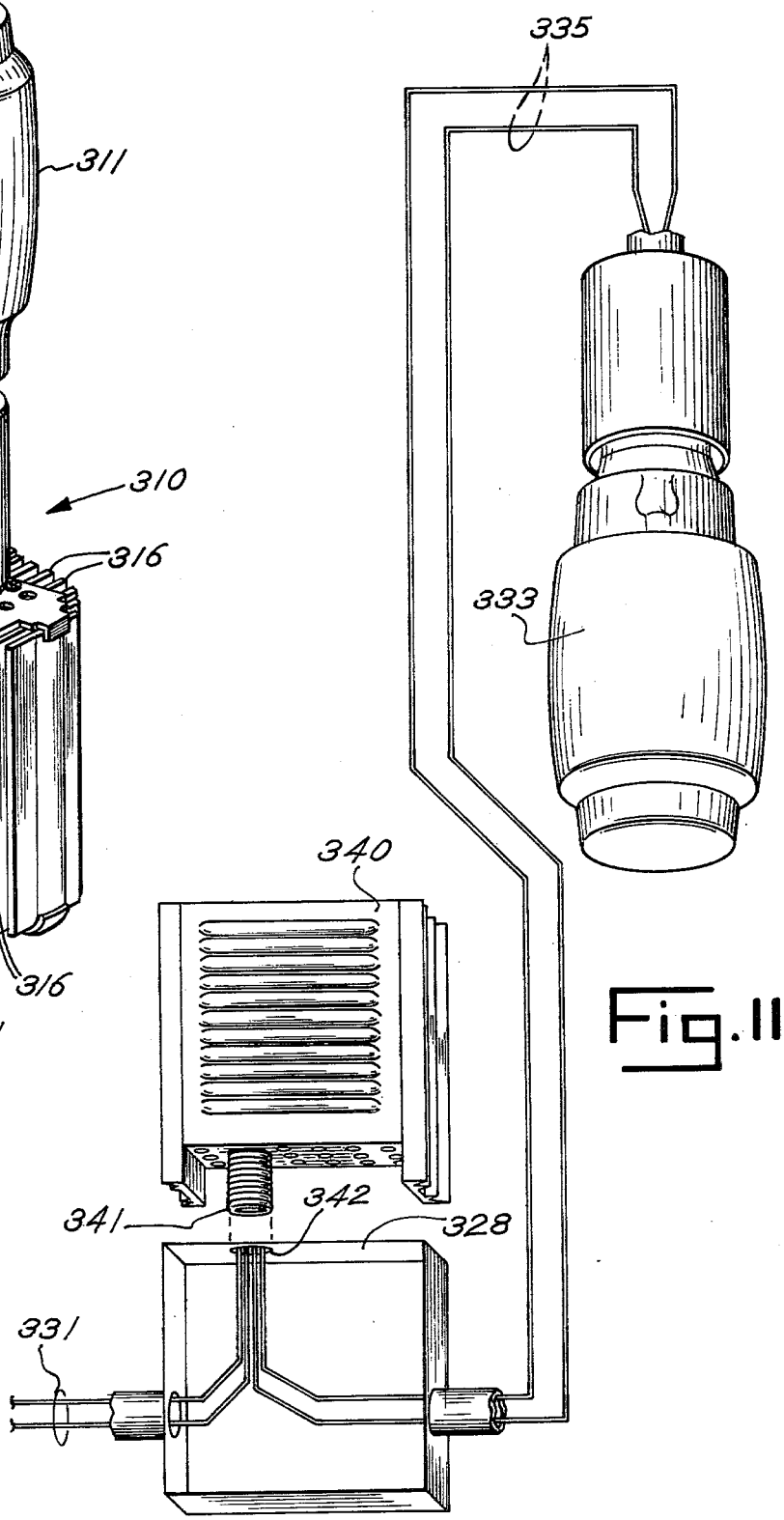

The small and compact nature of the ballast also permits its installation at electrical junction box locations in conventional household wiring systems as illustrated in FIG. 11. Two-wire AC line power enters the junction box 328 at 331 and DC power is delivered to the remote HID lamp 333 over the two conductors 335. The ballast housing indicated generally at 340 in FIG. 11 is provided with a conduit nipple 341 which is mounted through the knockout hole 342 in the junction box 328. Unlike conventional magnetic ballasts, the DC solidstate ballast contemplated by the present invention need not be positioned in close proximity to the lamp it operates, a particular advantage in many overhead and decorative lighting systems.

It is to be understood that the embodiments of the invention which have been described are merely illustrative of selected applications of the principles of the invention. Numerous modifications may be made to the circuits described without departing from the true spirit and scope of the invention.

What is claimed is:

1. In a electrical lighting system of the class comprising a resistive ballast circuit serially connected with an electric discharge lamp across a source of a direct current potential, the improvement comprising, in combination, means for decreasing the effective resistance of said ballast circuit in response to a decrease in the magnitude of current flowing through said lamp below a variable threshold level, and means for decreasing the value of said variable threshold level in response to an increase in the magnitude of voltage across said lamp.

2. The improvement set forth in claim 1 including means responsive to increases in the voltage across said lamp for increasing the magnitude of said direct current potential such that a substantially constant voltage is maintained across said ballast circuit.

3. The improvement set forth in claim 1 including a capacitor, a voltage step-up transformer having its primary winding connected to said capacitor and its secondary winding connected to said lamp, a charging circuit connected between said capacitor and said source of a direct current potential, and a voltage breakdown device connected to discharge said capacitor through said primary winding whenever the voltage across said capacitor reaches a predetermined value whereby high-voltage starting pulses are supplied to said lamp whenever the direct current potential produced by said source exceeds a predetermined value.

4. A power supply for an electric discharge lamp comprising, in combination, a source of a direct current potential, at least one semiconductor device having a control electrode and a transconductive path, said transconductive path being serially connected with said lamp across said source, a fixed ballast resistance connected in parallel with said transconductive path, circuit means for establishing a threshold current level, and means responsive to the magnitude of current flowing through said lamp for applying a control signal to said control electrode to maintain said transconductive path in a substantially non-conductive state as said lamp is heated immediately following ignition until lamp current decreases to said threshold current level, and for thereafter increasing the conductivity of said transconductive path in response to further decreases in lamp current below said threshold current level.

5. A power supply as set forth in claim 4 including means for increasing the magnitude of the direct current potential produced by said source in response to increases in the voltage across said lamp.

6. A power supply for an electric discharge vapor lamp comprising, in combination, a source of a direct-current potential, a resistive semiconductor ballast circuit connected in series with said lamp across said source, means for establishing a threshold current level, means for increasing the conductivity of said ballast circuit whenever the magnitude of current flowing through said lamp decreases below said threshold current level, and means for decreasing said threshold current level in response to increases in the magnitude of voltage across said lamp.

* * * * *